US008021217B2

(12) United States Patent
Tollar

(10) Patent No.: US 8,021,217 B2
(45) Date of Patent: Sep. 20, 2011

(54) SELF CONTAINED HEATING/COOLING ROOF TOP UNIT WITH BUILT IN INDEPENDENT PRESSURE RELIEF

(75) Inventor: Greig J. Tollar, Waterloo (CA)

(73) Assignee: MNE Engineering Inc., Kitchener Ontario (CA)

( * ) Notice: Subject to any disclaimer, the term of this patent is extended or adjusted under 35 U.S.C. 154(b) by 1243 days.

(21) Appl. No.: 11/674,379

(22) Filed: Feb. 13, 2007

(65) Prior Publication Data

US 2007/0190925 A1 Aug. 16, 2007

Related U.S. Application Data

(60) Provisional application No. 60/772,558, filed on Feb. 13, 2006, provisional application No. 60/780,381, filed on Mar. 9, 2006, provisional application No. 60/744,393, filed on Apr. 6, 2006.

(51) Int. Cl.
*F24F 7/02* (2006.01)

(52) U.S. Cl. ..... 454/242; 454/228; 454/231; 454/232; 454/233; 454/234; 454/236; 454/248; 454/249; 454/238

(58) Field of Classification Search ..... 454/242, 454/238, 236, 228, 231, 232, 233, 234, 248, 454/249
See application file for complete search history.

(56) References Cited

U.S. PATENT DOCUMENTS

| | | | | |
|---|---|---|---|---|
| 4,759,196 | A * | 7/1988 | Davis | 62/326 |
| 5,346,127 | A * | 9/1994 | Creighton | 236/13 |
| 6,325,012 | B1 * | 12/2001 | Aristizabal | 114/314 |
| 2003/0111219 | A1 * | 6/2003 | Edwards | 165/208 |
| 2004/0253918 | A1 * | 12/2004 | Ezell et al. | 454/239 |
| 2006/0273183 | A1 * | 12/2006 | Cavanagh et al. | 236/44 C |

* cited by examiner

*Primary Examiner* — Steven B McAllister
*Assistant Examiner* — Seth Greenia
(74) *Attorney, Agent, or Firm* — Daryl W. Schnurr

(57) ABSTRACT

A self-contained pre-manufactured roof top unit is used to circulate fresh air, heat or cool a building. The housing has a blower connected into a circulation system to circulate air into and out of the building. The unit has a pressure relief opening for connection into the building that is used to relieve air pressure buildup within the building. The pressure relief opening is part of a pressure relief passage that is independent of the blower and has an exhaust vent that opens and closes automatically in response to pressure differential between the building and ambient air.

24 Claims, 10 Drawing Sheets

SELF CONTAINED HEATING/COOLING ROOF TOP UNIT WITH BUILT IN INDEPENDENT PRESSURE RELIEF

Applicant claims the benefit of U.S. Provisional Applications Ser. No. 60/772,558 filed on Feb. 13, 2006, Ser. No. 60/780,381 filed on Mar. 9, 2006, and Ser. No. 60/744,393 filed Apr. 6, 2006.

BACKGROUND OF THE INVENTION

1. Field of the Invention

This invention relates to a self-contained pre-manufactured air unit for installation on a roof top of a building. This unit has three connection points for ductwork. One connection point is used to supply air to the building and the second connection point is used to return air from the building through an air circulation system that includes a blower. The third connection point is also part of the unit, but is connected independently of the blower and is used to relieve pressure within the building. The unit may have a heating coil, a cooling coil or a heating/cooling coil and an air inlet for ambient air.

2. Description of the Prior Art

Self-contained pre-manufactured roof top heating/cooling units are known in which the units have two duct connections points, one duct connection point to supply air to the interior of a building and the second to receive return air from the building. Relief and outdoor air intake damper assemblies are located within the unit at the point that the return air enters the unit. The relief damper is pressure operated and relieves some of the return air to the outside of the unit. The outdoor intake damper assembly introduces outdoor air into the supply duct to the building. The units have a main fan or blower to force air through the unit and cause air flow through the relief/outdoor air intake damper assemblies. The units can cause a pressure buildup in the building as buildings are now constructed to be airtight. It is important to introduce fresh air into the buildings for health reasons. The pressure buildup can cause exit doors in the building, some of which are designed to close automatically when someone enters or exits the building, to remain open, thereby creating a security risk. Further, the pressure buildup can cause damage to the building. It is known that the pressure buildup from the heating/cooling units can sometimes cause the roof of a building to partially separate from the building. The pressure buildup is often caused by the pressure operated relief damper within the housing not opening properly as the damper is subject to opposing forces caused by operation of the main fan. The damper is usually designed to open outward, but the intake pressure created by the fan can also pull the damper inward to the closed position. Also, when the damper is exposed to the weather, the wind can blow against the damper from outside to keep it in the closed position or the damper can be fixed in the closed position by a buildup of snow or ice.

In some previous roof top air units, attempts have been made to relieve air pressure within buildings by placing a secondary fan on an exhaust vent for some of the return air from the housing. The secondary fan often does not work very well to relieve pressure within the building because the secondary fan is opposed by the main fan or blower within the housing. The main fan or blower forces air into the building and causes return air to exit from the building. When the main fan or blower is operating, the damper in the exhaust vent can fail to open satisfactorily or will not operate properly as the secondary fan is pulling in one direction and that the main fan or blower is pulling the damper in the opposite direction.

SUMMARY OF INVENTION

It is an object of the present invention to provide a one embodiment self-contained pre-manufactured air unit for installation on a roof top of a building where the unit contains a third duct connection point. The third connection point is used for relief air only and is independent of the blower that forces air into the building through a first connection point and independent of the return air duct from the building, which is a second connection point. The third connection point is connected to an exhaust outlet from the unit. The exhaust outlet can have a pressure operated damper thereon that opens to exhaust air using building pressure only and closes when there is no building pressure. The third connection point can lead to a protected enclosure within the unit. The enclosure is preferably located in a condenser area of the unit, which already has one or more passages to exhaust air from the unit to ambient air. The pressure activated damper is preferably located between the enclosure and the condenser area in which the enclosure is located. By relieving air in this manner, the pressure operated damper can operate without the opposing forces caused by the blower in the unit and the damper will be protected from adverse weather conditions. The third connection point can also lead directly to an exhaust vent located on the exterior of the unit.

It is a further object of the present invention to provide an air unit that is mounted on a roof top of a building to circulate air through the building and back to the unit where the unit has an independent pressure relief opening. It is still a further object of the present invention to provide a method of relieving pressure from a building caused by the operation of a roof top air unit by locating a pressure relief opening that is connected into the building on the unit, the pressure relief opening being independent of the blower.

A self-contained pre-manufactured air unit is installed on a roof top of a building for circulating air through the building. The unit comprises a housing having a blower therein, the blower being connected into a circulation system to circulate air into and out of the building. The unit has a pressure relief opening for connection to the building, the pressure relief opening being independent of the blower and being connected to exhaust air from the building to ambient air when air pressure within the building exceeds a pressure of the ambient air.

A self-contained pre-manufactured air unit for installation on a roof top of a building and connection to the building for circulating air through the building comprises a housing having a first air inlet and a first air outlet. The first air outlet is connected into the building, the housing having a blower to force ambient air from the first air inlet through the first air outlet into the building. The housing has a second air inlet, the second air inlet being connected into the building to transport return air from the building into the housing. The housing has a third air inlet and a second air outlet, the second air outlet being an exhaust outlet. The third air inlet is connected into the building and is connected to the second air outlet independently of the blower to provide pressure relief to the building.

A self-contained pre-manufactured air unit for installation on a roof top of a building comprises a housing having a blower therein. The housing has an ambient air inlet and two openings for connection to the building, the blower being connected to force air into the building through a first of the two openings and to return air from the building to the blower through a second of the two openings. The unit has a pressure relief opening for connection to the building to receive air from the building. The pressure relief opening is independent of the ambient air inlet, the two openings and the blower, the pressure relief opening being connected to ambient air to exhaust air from the building when a pressure within said building exceeds a pressure of the ambient air.

A self contained pre-manufactured air unit for installation on a roof top of a building for circulating air through the building comprises a housing having a blower therein. The blower is connected to a first duct connection point and a second duct connection point. The first and second duct connection points are connected into a circulation system to circulate air into and out of the building. The unit has a pressure relief opening with a third duct connection point for connection to the building. The pressure relief opening is independent of the blower and is connected to exhaust air from the building to ambient air when air pressure within the building exceeds pressure of the ambient air.

A method of relieving pressure from a building uses a self-contained pre-manufactured air unit installed on a roof top of the building, said unit having a blower for circulating air through the building. The method comprises locating an independent pressure relief opening in the unit for connection into the building, connecting the pressure relief opening to ambient air to exhaust high-pressure air from the building, connecting the pressure relief opening to be independent of said blower.

DETAILED DESCRIPTION OF A PREFERRED EMBODIMENT

Figure 1:
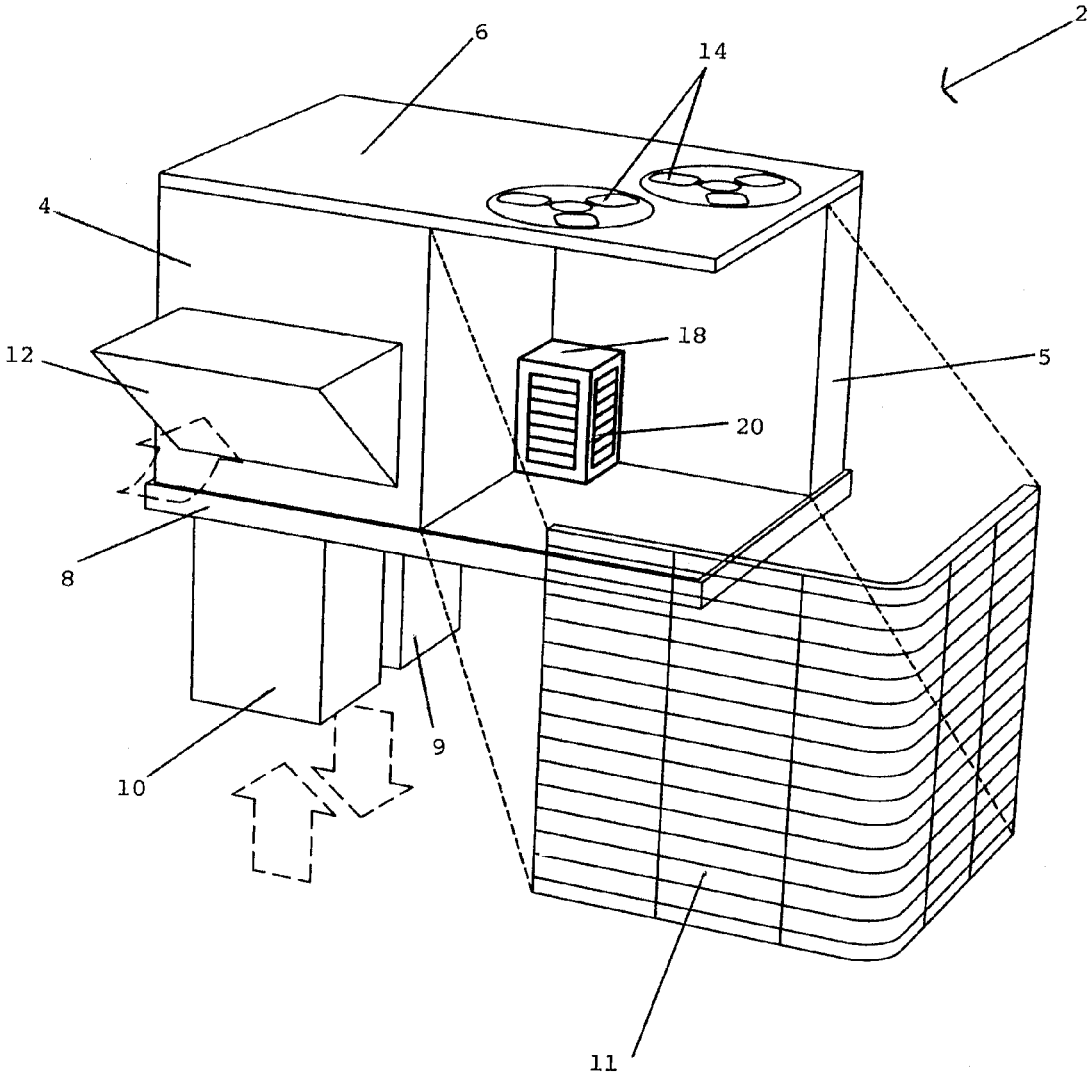
FIG. 1 is an exploded perspective view of a self-contained pre-manufactured heating/cooling unit.

In FIG. 1, an air unit 2 for mounting on a roof top of a building (not shown in FIG. 1) to heat or cool an interior of the building has a first housing 4 and second housing 5. While the unit can be used solely for air circulation, the unit is preferably used for heating and cooling and contains a condenser coil. The first and second housings 4, 5 have a top 6 and bottom 8 with a blower, condenser coil (all conventional and not shown), air outlet 9 and return air inlet 10 located within the first housing 4. The second housing 5 has a part of the condenser coil 11 extending around two sides thereof. The condenser coil 11 is connected to that part (not shown) of the coil located within the first housing 4. The first housing 4 has a first air inlet 12 to allow ambient air to enter the first housing 4 and to be forced into the building [not shown] by the blower (not shown) through the air outlet 9 located within the first housing 4. The fresh air (i.e. ambient air) is mixed with some of the return air from the return air inlet 10 and recirculated into the building through the air outlet 9. Fans 14 are mounted in the top 6 above the second housing 5 to create negative pressure within the second housing to assist in cooling the condenser coil 11. The condenser coil 11 is connected to the coil located in the first housing 4 and extends into the second housing 5 to allow heat that has built up in the coil within the first housing 4 to be dissipated in the second housing 5. An enclosure 18 is located within the second housing 5. The enclosure 18 contains a plurality of exhaust vents 20 that open and close in response to a pressure differential between the enclosure 18 and the second housing 5. The vents 20 are shown in a closed position. The enclosure 18 is connected to a second return air inlet that is used to relieve any pressure buildup within the building. The second return air inlet is independent of the blower. "Independent of the blower" means that the second return air inlet is isolated from the effects of the blower. The dotted arrows for the first air inlet 12, the air outlet and return air inlet are shown in the drawing to indicate the direction of air flow. The return air inlet 10 is a second air inlet.

Figure 2:
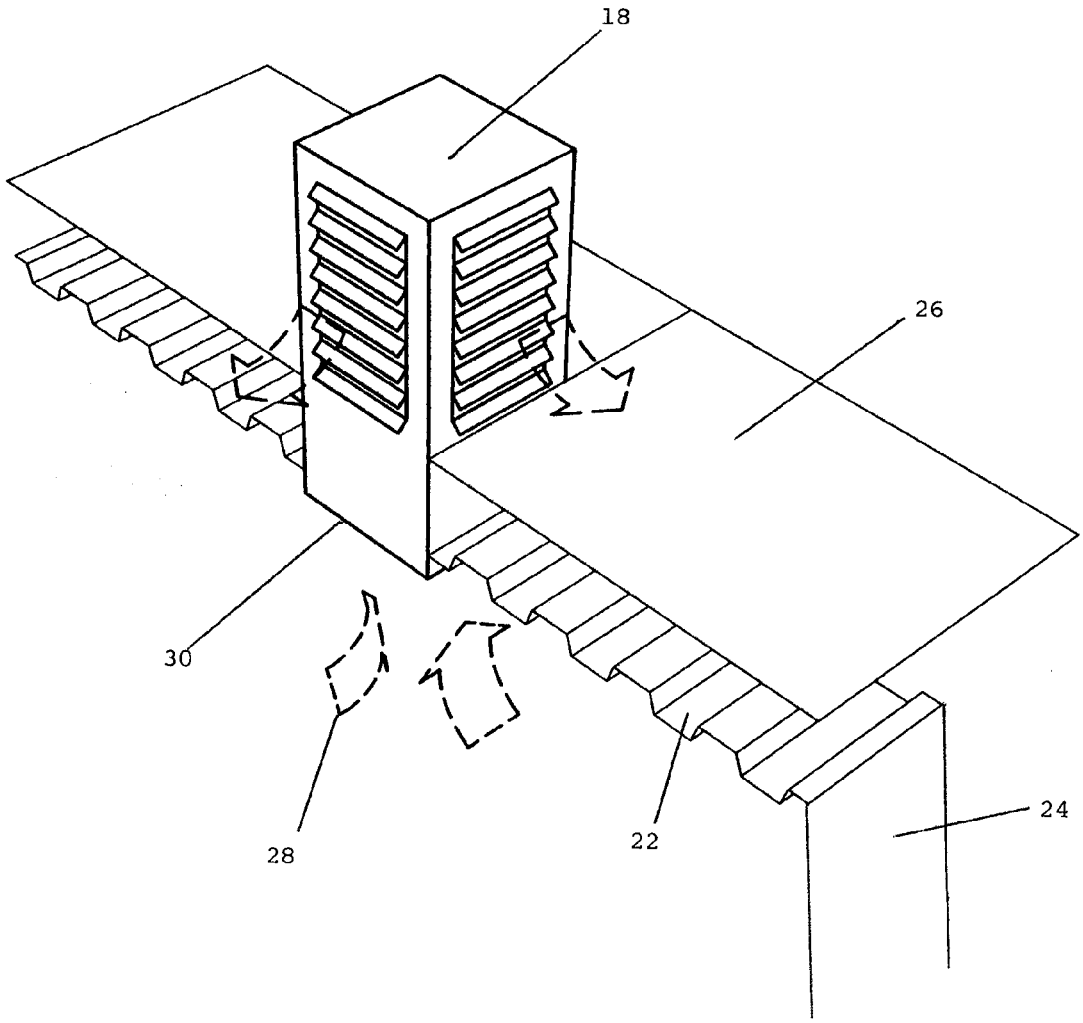
FIG. 2 is an enlarged partial perspective view of an enclosure of the unit installed in a roof of a building.

In FIG. 2, there is shown an enlarged partial perspective view of the enclosure 18 installed in a roof 22 of a building 24. The enclosure 18 is installed on a base 26, which is only partially shown, of the housings 4, 5. The housings 4, 5 have been deleted from FIG. 2 to simplify the drawing. There are dotted arrows 28 to indicate a direction of airflow from an interior of the building 24 into a relief air inlet 30, into the enclosure 18 and through the exhaust vents 20 into the housing 5 (not shown in FIG. 2). In FIG. 2, the exhaust vents 20 are shown in an open position. The relief air inlet 30 is a third air inlet.

In operation, the condenser coil can be operated to provide heating or cooling, as desired, in a conventional manner. A controller [not shown] activates the coil and the blower (not shown) to force ambient air through the first inlet 12, past the condenser coil (not shown) within the housing 4, through the air outlet 9 of the first housing 4 and into the building 24. When the unit 2 begins to operate, the air pressure within the second housing 5 may be greater than the air pressure within the enclosure 18 and the exhaust vents 20 will be closed. As the unit 2 continues to operate and force air into the building through the air outlet 9, the air pressure within the building may increase to such a level that air from the building will enter the enclosure 18 through the third air inlet 30. When the air pressure within the enclosure 18 exceeds the air pressure within the second housing 5, the exhaust vents 20 will open to reduce the pressure within the building and exhaust the air into the second housing 5. Therefore, when the air pressure within the building builds up, the excess pressure is automatically relieved through the exhaust vents 20 in the enclosure 18. The first housing 4 and second housing 5 are closed off from one another so that the air pressure in the first housing 4 has no direct effect on the air pressure in the second housing 5. The air in the second housing 5 is, in turn, exhausted to ambient air. When the air pressure within the enclosure 18 is equal to or less than the air pressure within the second housing 5, the exhaust vents 20 will be in the closed position. The exhaust vents 20 are designed to close by gravity when the pressure within the closure 18 is equal to or less than the pressure within the second housing 5 outside of the enclosure 18. The fans 14 can be activated to exhaust air from the enclosure 18 and the second housing 5, if necessary. While the housings 4, 5 are described as two housings, they could be described as a single housing with two compartments. The enclosure is protected from the weather and adverse wind conditions within the housing 5. There are two coils in housing 4, one for cooling and one for heating. Units can be set up for one or both of cooling and heating. The unit is used for both heating and cooling. The heating component and the cooling component can be the same component or separate components.

Figure 3:
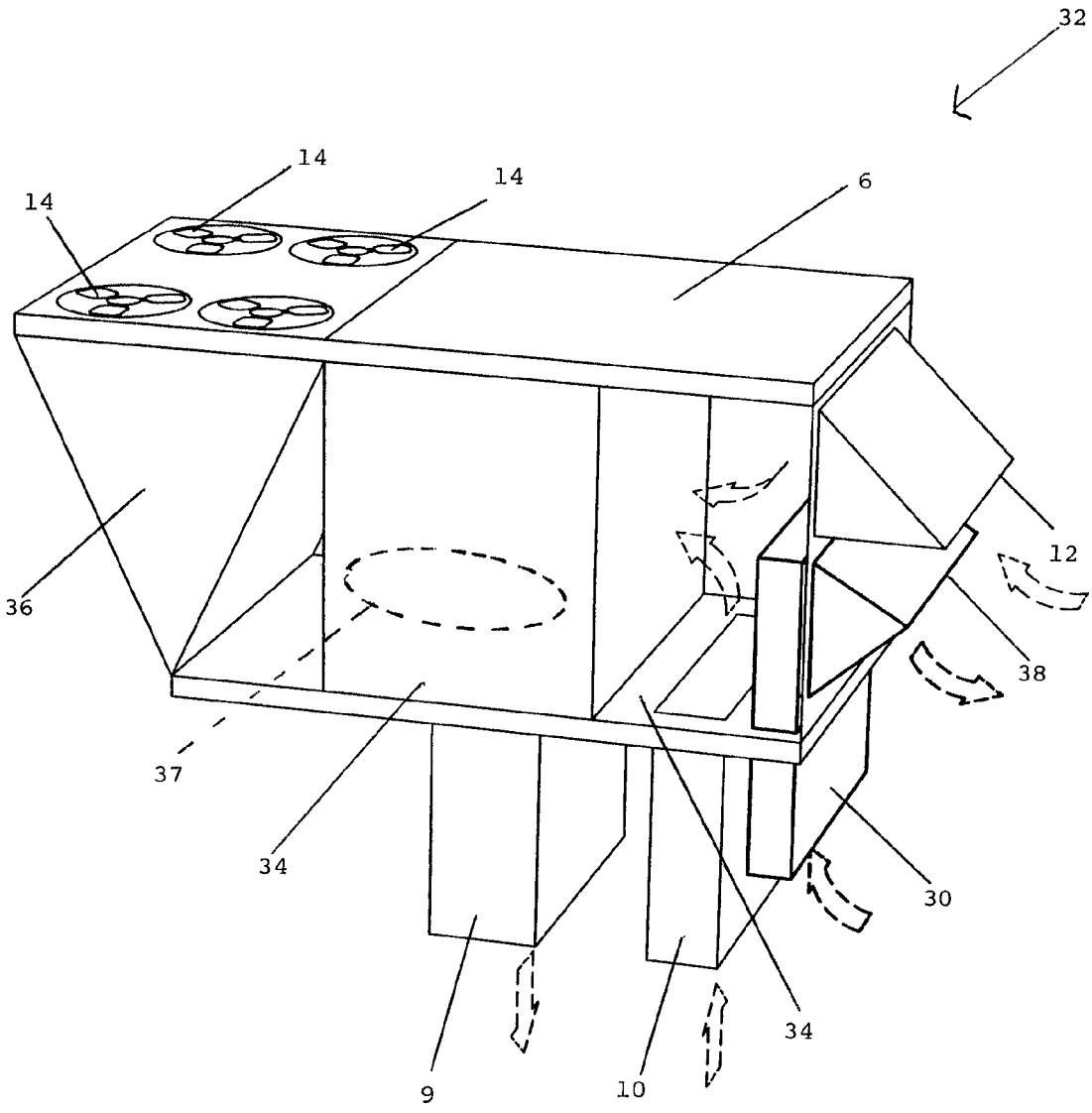
FIG. 3 is a partial perspective view of a further embodiment of a self-contained pre-manufactured heating/cooling unit having three connection points.

The same reference numerals are used in FIG. 3 as those used in FIGS. 1 and 2 to describe those components that are identical. An air unit 32 has a main housing 34 and a condenser housing 36. The main housing 34 contains a blower 37 (shown schematically) and, preferably, a heating/cooling component [not shown]. The blower is operative to force air from the first air inlet 12 into the building (not shown in FIG. 3) through the first air outlet 9. The blower also removes air from the building through the return air inlet 10. Some of the return air is mixed with fresh air from the first air inlet 12 and re-circulated back into the building. The return air inlet 10 is the second air inlet. A direction of airflow is indicated in FIG. 3 by dotted arrows. The dotted arrow 28 shows air flowing from an interior of the building into a relief air inlet 30 to ambient air through exhaust vent 38. The relief air inlet 30 is the third air inlet.

Preferably, the main housing 34 contains a heating/cooling coil (not shown), which is conventional and has a condensing section (not shown) extending into the housing 36. The fans 14 are operable to create a negative pressure within the condenser housing 36 to assist in cooling the condensing section. The air unit 32 is conventional except for the relief air inlet 30 and exhaust vent 38. The relief air inlet 30 is independent of the blower (not shown) and is independent of the second air inlet 10. The relief air inlet 30 allows air to escape from the building whenever there is a build up of pressure within the building. Both the first air inlet 12 and the exhaust vent 38 preferably contain movable dampers (not shown) that open and close in response to air pressure differential. For the first air inlet 12, when the air pressure within the housing 34 is less than the air pressure of the ambient air, the damper will open and ambient air will flow into the housing 34. For the exhaust vent 38, the damper will open when the pressure within the building and the relief air inlet 30 is greater than the pressure of the ambient air. The exhaust vent 38 is the second air outlet. The blower (not shown) is a fan. Still more preferably, the first air inlet 12 has motorized dampers that are controlled by air quality detectors located within the building. As more fresh air is needed, the dampers are opened by the detectors.

The air unit 32 of FIG. 3 is not as advantageous over the air unit 2 shown in FIGS. 1 and 2 because the exhaust vent 38 of the air unit 32 is exposed to the weather. However, the air unit 32 is advantageous over previous self-contained pre-manufactured air units. When the wind is blowing toward the exhaust vent 38, increased pressure will be required from the air flowing through the relief air inlet 30 in order to open the damper in the exhaust vent 38. In other words, the air pressure within the building must be higher to open the damper when wind is blowing ambient air toward the exhaust vent 38 than the air pressure has to be to open the damper when there is no wind blowing toward the exhaust vent 38. With the air unit 2, the exhaust vents 20 are protected from the weather as they are located within the second housing 5. The damper in the exhaust vent 38 can also be jammed in the closed position by a buildup of ice or snow against an outside of the damper. If that situation were to occur, the pressure relief system would be rendered inoperable as air from the building could not flow through the relief air return 30 and out the exhaust vent 38.

Figure 4:
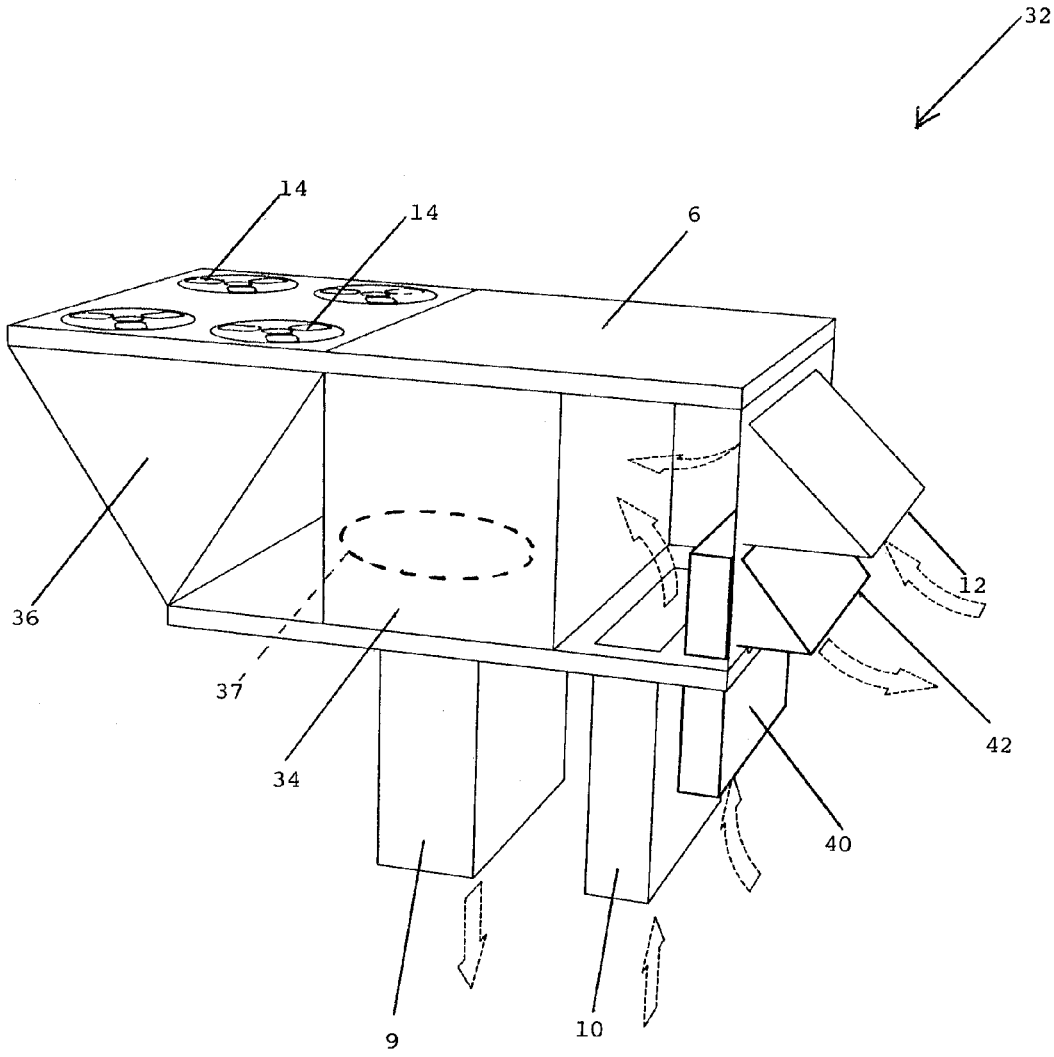
FIG. 4 is a partial perspective view of a further embodiment of a self-contained pre-manufactured heating/cooling unit having three connection points where a mouth of a pressure relief vent is horizontal.
Figure 5:
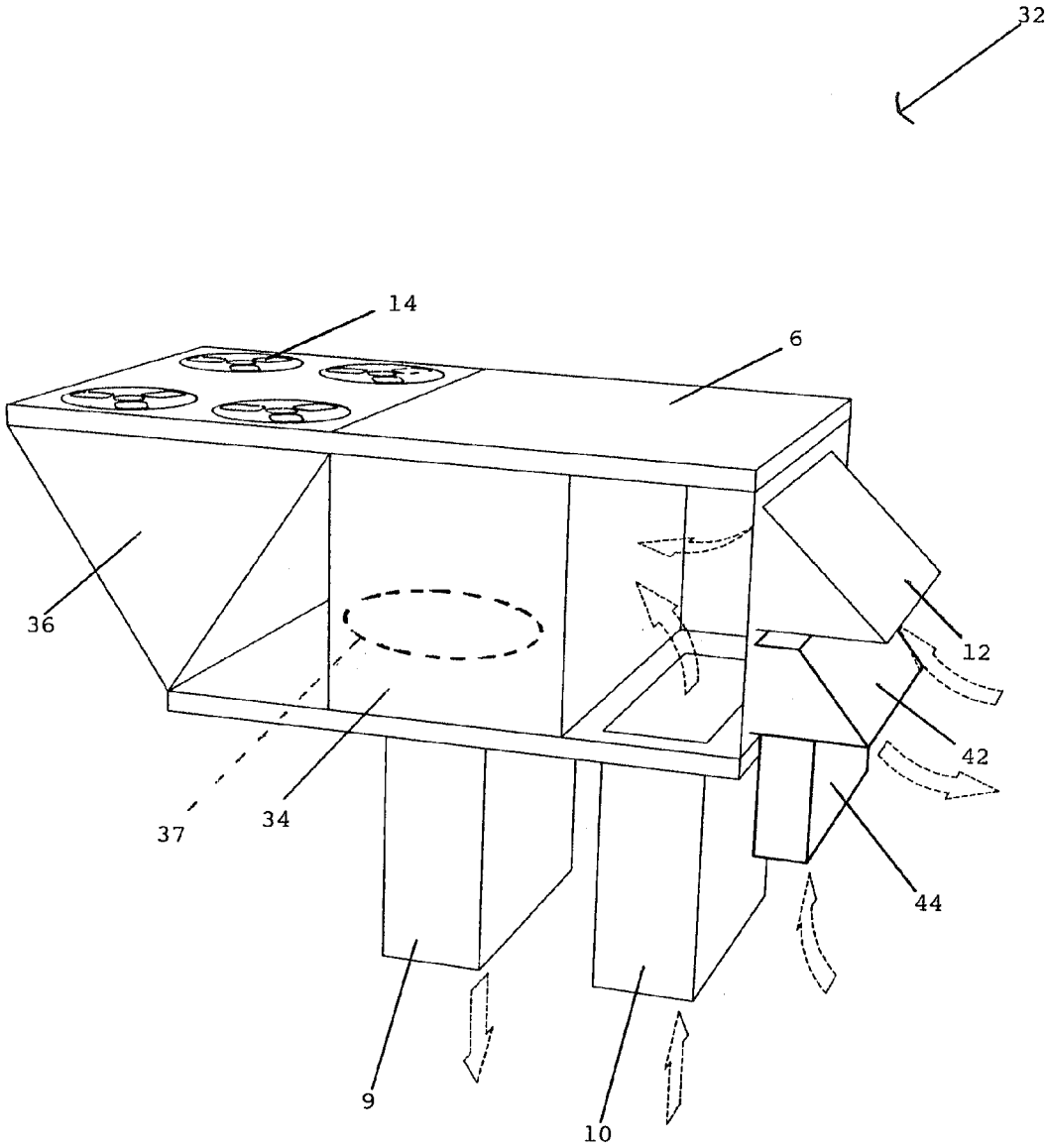
FIG. 5 is a partial perspective view of a further embodiment of a self-contained pre-manufactured heating/cooling unit having three connection points where an independent pressure relief passage is located outside of a housing.

In FIGS. 4 and 5, there are shown further embodiments of a heating/cooling unit with variations in a pressure relief passage. The same reference numerals are used in FIGS. 4 and 5 as those used in FIG. 3 to describe those components that are identical. The reference numeral 32 is used for the unit in both FIGS. 4 and 5 as the variation is in the location of the pressure relief passage. In FIG. 4, a pressure relief passage 40 has an extension on an exhaust vent 42 compared to the exhaust vent 38 shown in FIG. 3. The extension provides a mouth (not shown in FIG. 4) that is horizontal and therefore much more protected from the wind than the exhaust vent 38 shown in FIG. 3.

In FIG. 5, a pressure relief passage 44 is located outside of the main housing 34. Both the pressure relief passages 40 (of FIG. 4) and 44 (of FIG. 5) are connected into the building (not shown in FIGS. 4 and 5) to relieve excess pressure from the building. The pressure relief passages 40, 44 are independent from the air circulation system that is represented by the first air outlet 9, the second air inlet 10 and the blower (not shown) located within the main housing 34. The exhaust vent 42 can be extended even further beyond the horizontal position shown to further protect the damper 46 from the wind or weather conditions while still leaving a sufficient opening at the mouth to allow air from the building to escape to the atmosphere.

Figure 6:
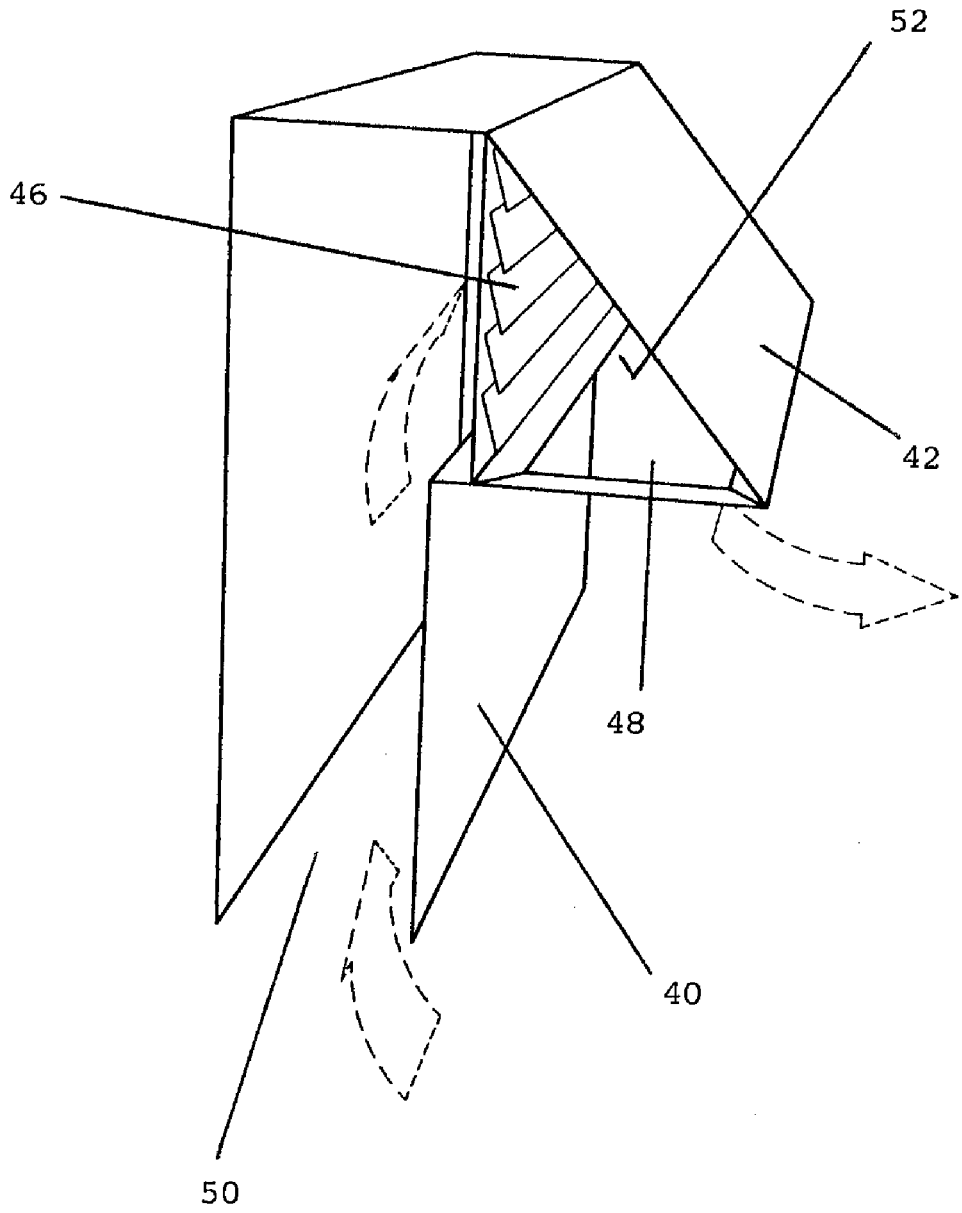
FIG. 6 is a partial schematic perspective view of part of a pressure relief passage of FIG. 4.
Figure 7:
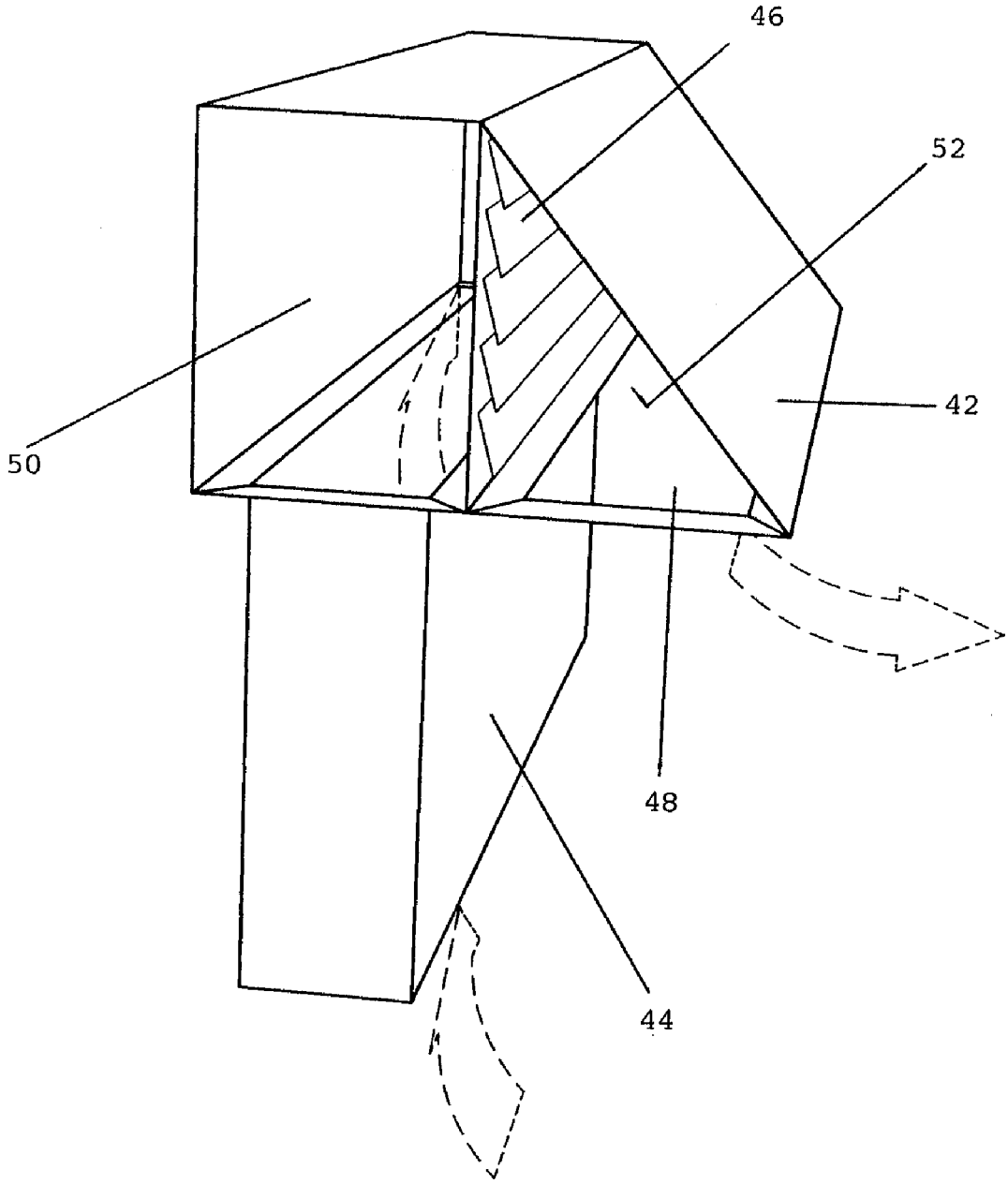
FIG. 7 is a partial schematic perspective view of part of the pressure relief passage of FIG. 5.

In FIG. 6, there are shown a schematic perspective view of the pressure relief passage 40, which has a damper 46 and a mouth 48. In FIG. 7, there are shown a schematic perspective view of the pressure relief passage 44, which has the damper 46 and the mouth 48. The damper 46 is designed to open in response to pressure differential between air on an upstream side 50 and air on a downstream side 52 of the damper. When the air on the upstream side 50 has a greater pressure than the air on the downstream side 52, the damper 46 will open and when the pressure of the air on the upstream side 50 does not exceed the pressure of the air on the downstream side 52 the damper will be closed. The mouth 48 is horizontal to minimize the influence that the wind will have on the damper 46.

In FIGS. 4 to 7, the dotted arrows show the direction of air flow through the unit. In both FIGS. 4 and 5, ambient air flows in the air inlet 12 and mixes with air returning from the building through the return air 10 due to the operation of the blower 37. The blower 37 forces the air into the building (not shown) through the air outlet 9. When air pressure within the building exceeds the pressure outside of the damper 46, air will flow from the building through the air relief passage to the ambient air. Since the air relief passage is independent of the air circulation system, including the blower 37, the blower 37 has no influence on the operation of the damper 46 other than to build up pressure within the building. When the air unit, which can be used to heat, cool or just to circulate air through the building, is installed on the roof of a building, the unit is usually installed on a roof mounting curb (not shown) which is mounted on a metal roof deck (not shown in FIGS. 4 to 7). When the pressure relief passage is located outside of the unit, preferably the roof curb, is extended to include a duct 54 that extends into the building (not shown) as part of the pressure relief passage. The same reference numerals are used in FIGS. 5 and 7 as those used in FIGS. 4 and 6 respectively for those components that are identical.

Each of the first air outlet 9, the second air inlet 10 and the third air inlet 30 (or 40 or 44) are air ducts that extend into the building, but are only partially shown in FIGS. 1 to 3. The air units or heating/cooling units, in self-contained pre-manufactured state when shipped, will have three duct connection points thereon to which air ducts can be connected when the units are installed on the roof of the building. The air ducts are partially shown in FIGS. 1 to 7 to improve the description of the unit. The partial ducts are shown in the drawings but are preferably not be part of the self-contained unit. The unit is preferably shipped to an installation site with ducts only pre-installed to the duct connection points. The ducts extending from the duct connector point between the unit and the building are installed on site.

Figure 8:
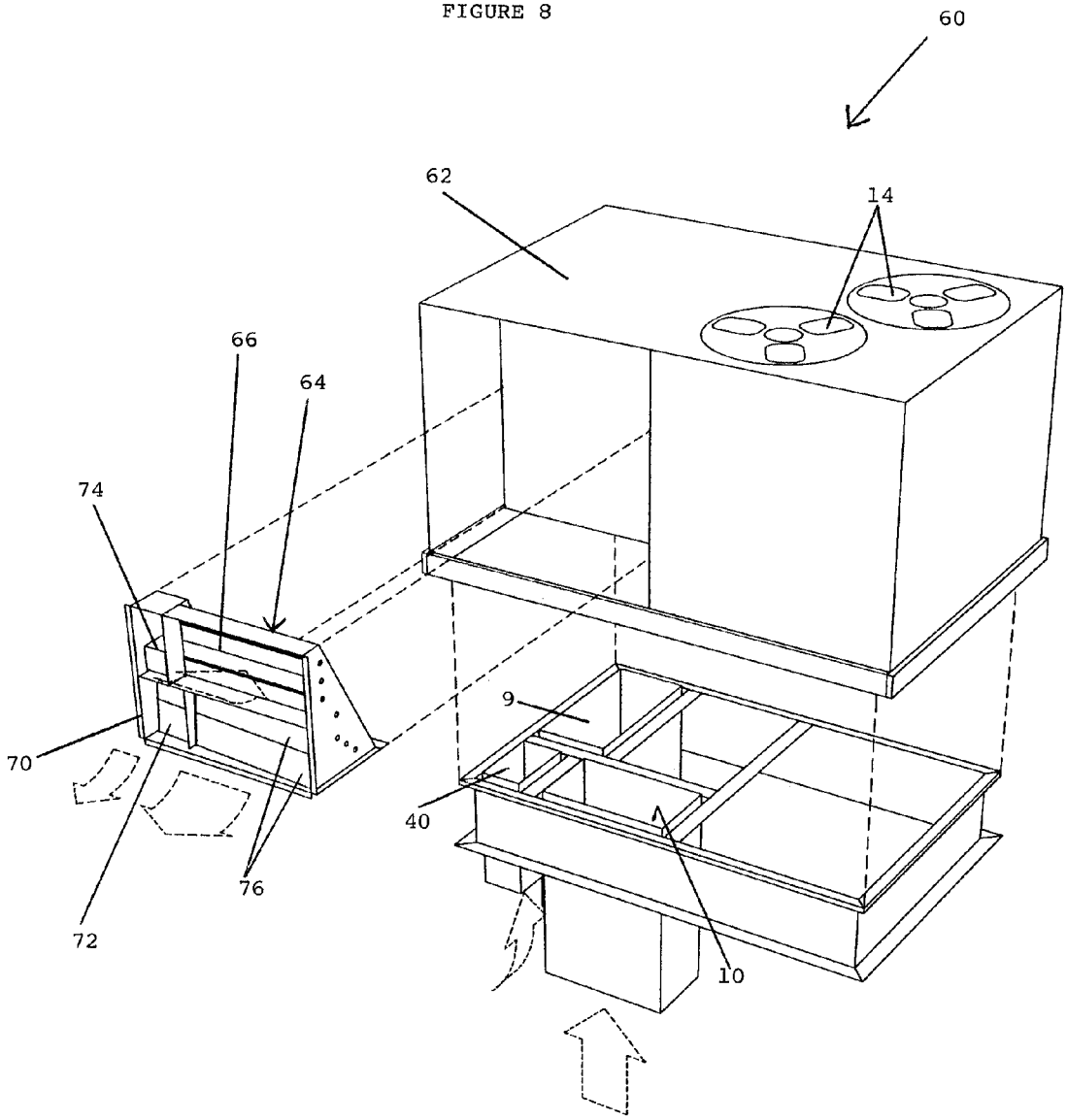
FIG. 8 is an exploded perspective view of a further embodiment of a self-contained pre-manufactured heating/cooling unit with an independent pressure relief passage.
Figure 9:
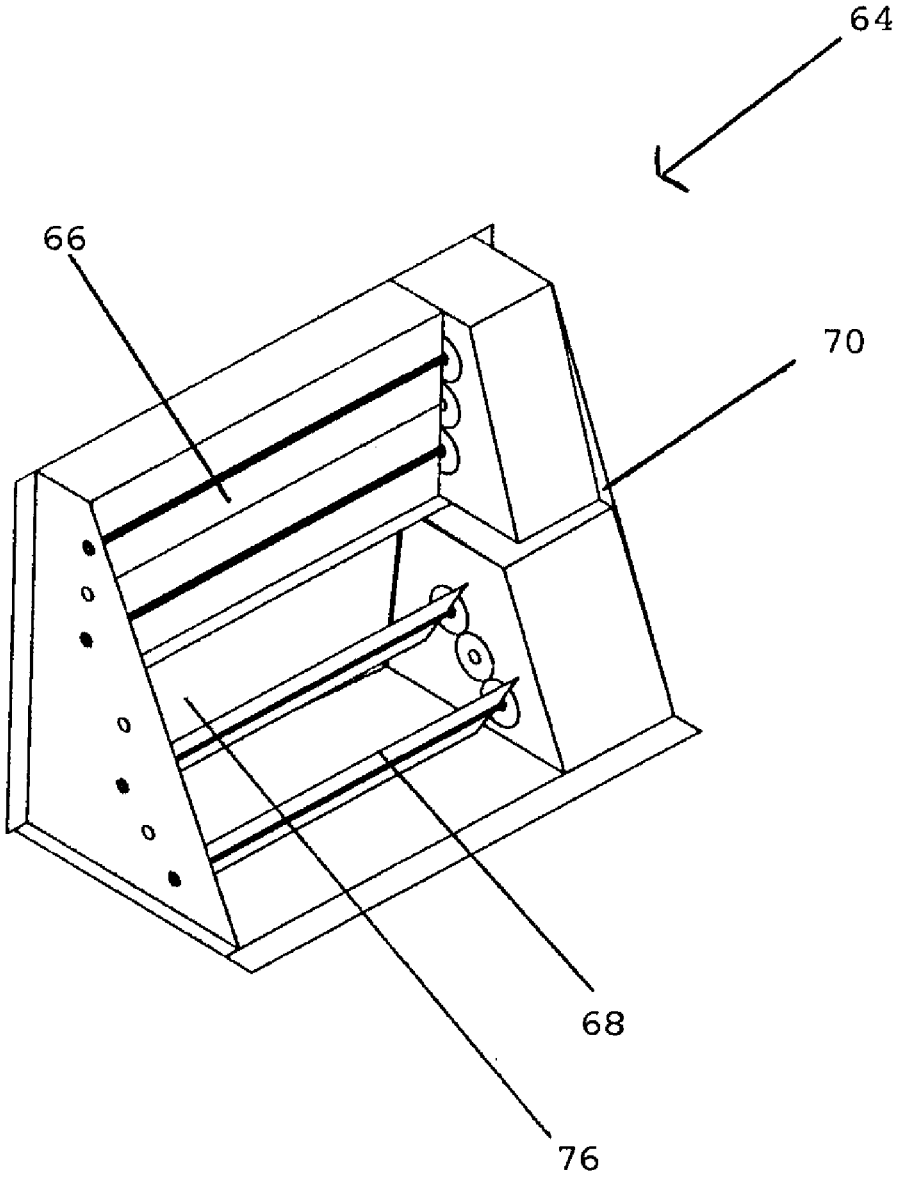
FIG. 9 is a perspective view of a dual damper for the embodiment shown in FIG. 8.
Figure 10:
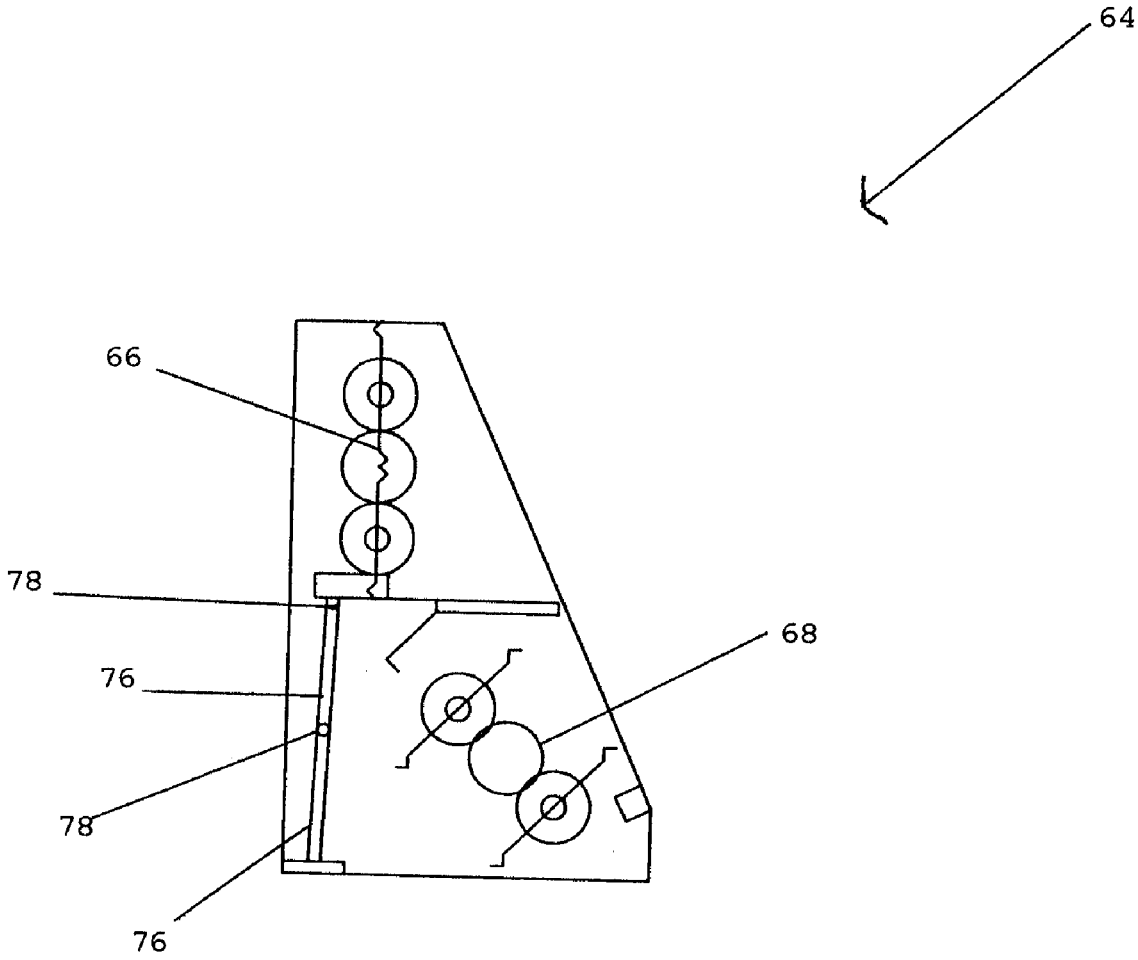
FIG. 10 is a schematic side view of the damper of FIG. 9.

In FIG. 8, a self-contained, pre-manufactured heating/cooling unit 60 has an air outlet 9 into a building (not shown), a return air inlet 10 from the building and an independent relief inlet 40 from the building located within a housing 62 of the unit 60. The unit 60 has coils for heating/cooling that are conventional and are not shown in FIG. 8. The same reference numerals are used in FIG. 8 as those used in FIGS. 1 and 4 to describe those components that are identical. A triple damper 64 is located above the return air inlet 10 and the independent relief air inlet 40. Fresh ambient air enters through an upper damper 66 and is mixed with the return air from the return air inlet 10 (not shown) and circulated back into the building through the air outlet 9 by the blower. Some of the return air is exhausted to ambient air through a lower damper 68 (not shown in FIG. 8, but see FIGS. 9 and 10). The independent relief air passage 40 is connected into a side 70 of the triple damper 64 and the side 70 has a third damper 72 that is located to receive relief air through the relief air inlet 40 from the building and exhaust the relief air through the third damper 72 to ambient air. The third damper 72 closes when pressure of air within the relief inlet 40 is equal to or less than the ambient air and opens when the pressure within the relief inlet 40 is greater than the pressure of the ambient air. The third damper 72 and the relief inlet 40 are independent of the upper damper 66, the lower damper 68 and the blower. Hinged gates 76 are located outside of the lower damper 68 (not shown in FIG. 8) to prevent ambient air from entering the lower damper 68. A motor 74 is connected to operate the upper damper 66 and the lower damper 68 simultaneously so that as the upper damper opens, the lower damper closes and vice versa. Preferably, the dampers are controlled so that the upper damper is opened by the same amount that the lower damper is closed at all times, and when the upper damper is 100% open, the lower damper is 100% closed and vice versa. The same reference numerals are used in FIGS. 9 and 10 as those used in FIG. 8 for those components that are identical. In FIGS. 9 and 10, the upper damper 66 is in a closed position and the lower damper 68 is in an open position. FIG. 10 is a schematic side view of the upper and lower dampers 66, 68 respectively. The third damper 72 is not shown in FIG. 10. There are two gates 76 that are hinged on pins 78 that are located outside of the lower damper 68. The gates open outward when return air is exhausted through the lower damper 68 but prevents ambient air from entering the housing (not shown in FIG. 10) through the lower damper 68. The gates 76 close when ambient air begins to enter the lower damper 68.

Preferably, when return air arrives at the blower through the air return, some fresh air from the first air inlet is mixed with the return air and the mixture of the fresh air and return air is circulated into the building through the first air outlet. The arrows on the drawings represent the direction of air flow.

I claim:

1. A self-contained pre-manufactured air unit for installation on a roof top of a building for circulating air through said building, said unit comprising a housing having a blower therein, said blower being connected into a circulation system comprising a first air outlet for flowing air to the building and a second air inlet for returning air from the building to circulate air into and out of said building, said unit having a pressure relief opening for connection to said building, said pressure relief opening being separate from said second air outlet and said first air inlet, and being independent of said blower such that a vacuum created by the blower within the housing does not affect a pressure in the pressure relief opening, wherein the pressure relief opening is connected to exhaust air from said building to ambient air when air pressure within said building exceeds a pressure of said ambient air; said pressure relief opening is connected via a duct to an exhaust vent in said unit, said exhaust vent having a damper that opens automatically when said air pressure within said building exceeds a pressure of said ambient air and closes when the air pressure within said building does not exceed a pressure of said ambient air.

2. An air unit as claimed in claim 1 wherein said pressure relief opening is located in a pressure relief passage that extends beyond said damper by a sufficient distance to protect said damper from adverse wind and weather conditions.

3. An air unit as claimed in claim 2 wherein said pressure relief passage has a mouth located beyond said damper that is oriented to be substantially horizontal.

4. An air unit as claimed in claim 3 wherein said damper is substantially vertical when said damper is in a closed position.

5. An air unit is claimed in claim 2 wherein said pressure relief passage extends through said housing.

6. An air unit as claimed in claim 2 wherein said pressure relief passage is located outside of said housing.

7. An air unit as claimed in claim 1 wherein said unit has a coil to heat or cool said building.

8. An air unit as claimed in claim 1 wherein said housing comprises a first and second compartment, said first compartment containing said blower and part of said circulation system, said second compartment containing said pressure relief opening.

9. An air unit as claimed in claim 1 wherein said pressure relief opening contains an air inlet connected to receive air from an interior of said building.

10. An air unit as claimed in claim 8 wherein said first compartment is isolated from said second compartment.

11. An air unit as claimed in claim 8 wherein said pressure relief opening is contained in an enclosure located in said second compartment, said enclosure having at least one exhaust vent to said second compartment, said second compartment having an opening to ambient air.

12. An air unit as claimed in claim 8 wherein said unit contains a coil selected from the group of a heating coil, a cooling coil and a heating/cooling coil to heat or cool air being circulated through said building.

13. An air unit as claimed in claim 11 wherein said at least one exhaust vent automatically opens when an air pressure within said building is greater than a pressure of said ambient air and automatically closes when an air pressure within said building is equal to or less than said pressure of ambient air.

14. An air unit as claimed in claim 11 wherein said enclosure is located within said second compartment in such a manner that said enclosure is protected from adverse weather conditions outside of said unit.

15. A self-contained pre-manufactured air unit for installation on a roof top of a building and connection to said building for circulating air through said building in an air circulation system, said unit comprising a housing having a first air inlet and a first air outlet, said first air outlet being connected into said building, said housing having a blower to force ambient air from said first air inlet through said first air outlet into said building, said housing having a second air inlet, said second air inlet being connected into said building to transport return air from said building into said housing, said housing having a third air inlet and a second air outlet, said second air outlet being an exhaust outlet, said third air inlet being connected into said building separately from said first aid inlet and said second air inlet and being connected via a duct to said second air outlet independently of said second air inlet and independently of said blower such that a vacuum created by the blower within the housing does not affect a pressure at the second air outlet, and to provide pressure relief to said building; said second air outlet having a damper that opens automatically when said air pressure within said building exceeds a pressure of said ambient air and closes when the air pressure within said building does not exceed a pressure of said ambient air.

16. A self-contained pre-manufactured air unit for installation on a roof top of a building, said unit comprising a housing having a blower therein, said unit being self-contained and pre-manufactured, said housing having an ambient air inlet and having two openings for connection to said building, said blower being connected to force air into said building through a first of said two openings and to return air from said building to said blower through a second of said two openings in an air circulation system, said unit having a pressure relief opening for connection to said building separate from said first of said two openings and said second of said two openings to receive air from said building such that a vacuum created by the blower within the housing does not affect a pressure at the second air outlet, said pressure relief opening being independent of said ambient air inlet, said two openings and said blower, said pressure relief opening being connected to ambient air to exhaust air from said building when a pressure of air within said building exceeds a pressure of said ambient air; said pressure relief opening is connected via a duct to an exhaust vent in said unit, said exhaust vent having a damper that opens automatically when said air pressure within said building exceeds a pressure of said ambient air and closes when the air pressure within said building does not exceed a pressure of said ambient air.

17. An air unit as claimed in claim 16 wherein said pressure relief opening extends to form a passage beyond said damper by a sufficient distance to protect said damper from adverse wind and weather conditions.

18. An air unit as claimed in claim 17 wherein said pressure relief passage has a mouth located beyond said damper that is oriented to be substantially horizontal.

19. An air unit as claimed in claim 18 wherein said damper is substantially vertical when said damper is in a closed position.

20. A self-contained pre-manufactured air unit for installation on a roof top of a building for circulating air through said building, said unit comprising a housing have a blower therein, said blower being connected to a first duct connection point and a second duct connection point, said first and second duct connection points being connected into a circulation system to circulate air into and out of said building, said unit having a pressure relief opening with a third duct connection point for connection to said building, said pressure relief opening being independent of said blower such that a vacuum created by the blower within the housing does not affect a pressure at the second air outlet, and being connected to exhaust air from said building to ambient air when air pressure within said building near said third duct connection point exceeds a pressure of said ambient air; said pressure relief opening is connected via a duct to an exhaust vent in said unit, said exhaust vent having a damper that opens automatically when said air pressure within said building exceeds a pressure of said ambient air and closes when the air pressure within said building does not exceed a pressure of said ambient air.

21. An air unit as claimed in claim 1 wherein said pressure relief opening is connected to said building through a separate duct from said air circulation system.

22. An air unit as claimed in claim 21 wherein said pressure relief opening is isolated from a negative pressure of said blower.

23. An air unit as claimed in claim 22 wherein said pressure relief opening is fluidly isolated from any other negative pressure inside of said housing.

24. An air unit as claimed in claim 22 wherein said pressure relief opening is structurally isolated from said blower.

* * * * *